US007695408B2

(12) United States Patent
Schmehl et al.

(10) Patent No.: US 7,695,408 B2
(45) Date of Patent: Apr. 13, 2010

(54) ELLIPTICAL EXERCISE DEVICE AND METHODS OF USE

(75) Inventors: Stewart Jacob Schmehl, Pinehurst, NC (US); Jacob Stewart Schmehl, Lake Hopatcong, NJ (US)

(73) Assignee: SJS Holdings, LLC, Pinehurst, NC (US)

( * ) Notice: Subject to any disclaimer, the term of this patent is extended or adjusted under 35 U.S.C. 154(b) by 605 days.

(21) Appl. No.: 11/507,806

(22) Filed: Aug. 22, 2006

(65) Prior Publication Data

US 2008/0051258 A1 Feb. 28, 2008

(51) Int. Cl.
*A63B 22/04* (2006.01)
*A63B 22/06* (2006.01)

(52) U.S. Cl. ..... 482/52; 482/57

(58) Field of Classification Search ..... 482/51, 482/52, 53, 57, 70
See application file for complete search history.

(56) References Cited

U.S. PATENT DOCUMENTS

| | | | | |
|---|---|---|---|---|
| 5,383,829 | A | 1/1995 | Miller | |
| 5,419,572 | A | 5/1995 | Stiller et al. | |
| 5,788,610 | A | 8/1998 | Eschenbach | |
| 5,833,583 | A | 11/1998 | Chuang | |
| 5,957,814 | A | 9/1999 | Eschenbach | |
| 5,997,445 | A | 12/1999 | Maresh et al. | |
| 6,077,198 | A | 6/2000 | Eschenbach | |
| 6,135,926 | A * | 10/2000 | Lee | 482/57 |
| 6,168,552 | B1 | 1/2001 | Eschenbach | |
| 6,217,486 | B1 * | 4/2001 | Rosenow | 482/52 |
| 6,334,836 | B1 | 1/2002 | Segasby | |
| 6,338,698 | B1 * | 1/2002 | Stearns et al. | 482/52 |
| 6,436,007 | B1 | 8/2002 | Eschenbach | |
| 6,440,042 | B2 | 8/2002 | Eschenbach | |
| 6,689,019 | B2 * | 2/2004 | Ohrt et al. | 482/52 |
| 6,719,666 | B1 * | 4/2004 | Lo et al. | 482/52 |

(Continued)

FOREIGN PATENT DOCUMENTS

| | | |
|---|---|---|
| WO | WO 2005/061056 | 7/2005 |

(Continued)

OTHER PUBLICATIONS

International Search Report, PCT/US2007/017464, Mar. 7, 2008.

(Continued)

*Primary Examiner*—Loan H Thanh
*Assistant Examiner*—Allana Lewin
(74) *Attorney, Agent, or Firm*—Kilpatrick Stockton LLP

(57) ABSTRACT

An exercise device can include a pair of pedal members, each of which can be rotatably connected on at least one end to a planet gear that is rotatable about a sun gear on each side of the device. The pedal members and the planet gears can be rotated to provide an elliptical exercise motion. The device can include a mechanism for simultaneously rotating each of the sun gears together to change the orientation of the elliptical exercise motion relative to a user. The orientation of an elliptical exercise motion can be changed dynamically from one orientation to another, for example, from horizontal to uphill or downhill, during a particular workout period. The exercise device can change the orientation of an elliptical exercise motion while maintaining a user's ankles at a substantially constant angle during the exercise cycle.

8 Claims, 8 Drawing Sheets

U.S. PATENT DOCUMENTS

| | | | | |
|---|---|---|---|---|
| 6,830,538 | B2 * | 12/2004 | Eschenbach | 482/52 |
| 6,846,273 | B1 * | 1/2005 | Stearns et al. | 482/52 |
| 6,994,657 | B1 | 2/2006 | Eschenbach | |
| 7,101,316 | B2 * | 9/2006 | Rosenow et al. | 482/52 |
| 2002/0107112 | A1 * | 8/2002 | Lim | 482/51 |
| 2004/0005960 | A1 * | 1/2004 | Chang | 482/52 |
| 2006/0183605 | A1 | 8/2006 | Dyer et al. | |
| 2007/0298935 | A1 * | 12/2007 | Badarneh et al. | 482/52 |

FOREIGN PATENT DOCUMENTS

| | | | |
|---|---|---|---|
| WO | WO2005061056 | * | 7/2005 |

OTHER PUBLICATIONS

Written Opinion of the International Searching Authority, PCT/US2007/017464, Mar. 7, 2008.

* cited by examiner

ELLIPTICAL EXERCISE DEVICE AND METHODS OF USE

FIELD OF THE INVENTION

The present invention relates to an exercise device and methods of using an exercise device. Embodiments of the present invention are useful, for example, for changing the orientation of an elliptical exercise motion while using the device.

BACKGROUND OF THE INVENTION

The benefits of regular exercise are well documented. To facilitate regular exercise, a number of exercise and fitness machines are now available for both commercial and in-home use. One of the more recently developed fitness machines is the so-called elliptical trainer. Elliptical exercise machines comprise various mechanisms to create a more or less elliptical exercise path for the user that provides the benefits of walking or running on a treadmill while reducing impact stress on the user's joints, such as the knees and hips.

Conventional elliptical exercise machines provide elliptical pedal motion by virtue of various reciprocating members and geared linkage systems. For example, elliptical pedal motion can be generated by a pair of foot pedal members driven on one end by a bicycle-type wheel, or bell crank, about a pivot axis. The pedal members can be guided on the other end by swinging arms or by being slidingly or rollingly engaged with a linear track or ramp. The wheel allows the foot pedals to move in upward and downward directions, while the slide or roller configuration allows the pedals to move in forward and backward directions. Such configurations result in a reciprocating, pseudo-elliptical exercise path and limit the range of exercise motion to the fixed circular guide path of the wheel or crank.

If the user of a conventional elliptical exercise machine is standing in an upright position, the exercise motion is generally in the form of a horizontal ellipse, such that the major axis of the ellipse is in the horizontal plane. It may be desirable to change the orientation of the exercise motion to provide a variety of "uphill" and "downhill" motions in an exercise program. In some conventional elliptical exercise devices, the orientation of the exercise motion ellipse cannot be changed from a preset orientation, such as an orientation in which the ellipse has a horizontal major axis.

Other conventional elliptical-type exercise machines allow for adjusting the orientation of the exercise motion. For example, a roller guide track that provides for generation of an elliptical path may be disengaged from one support position on a frame and re-engaged in another support position in order to change the exercise path. In another conventional elliptical exercise machine design, an upright support member connected to a bicycle wheel can be adjusted to allow for variable pedal motion.

One disadvantage of adjusting an elliptical exercise path in such conventional devices is that the adjustments often must be made manually. For a manual change of an elliptical exercise path, a user generally must stop use of the device, dismount the device, and physically move components of the device related to generation of an elliptical exercise path. Such manual changes to an elliptical exercise path can disrupt an exercise routine and may be so complicated or strenuous that users may opt not to make such changes, thereby defeating the purpose of having a device with an adjustable elliptical exercise path.

In a conventional elliptical trainer, a pedal can be attached to an arm on a planetary gear that is rotatable about a sun gear. The exercise path can be changed by moving the point of pedal attachment to discrete attachment points on the arm. By changing the point at which the user's foot exerts force on the planetary gear, the exercise motion of the planetary gear about the fixed sun gear can be changed. Such a means for changing the shape of an exercise motion has several disadvantages. In addition to the change having to be made manually, the change can only be made between the discrete, separated points of contact on the planetary gear arm. As a result, the exercise motions are limited to the orientations of an ellipse at those particular points of contact. However, it may be desirable to change an elliptical exercise motion to any orientation along a continuum between horizontal and vertical and to be able to provide those exercise motions in either an "uphill" or "downhill" orientation.

To alter an exercise path by achieving a longer stride, conventional elliptical cross trainers often use exaggerated pedal articulation. In elliptical-type exercise devices in which one end of a pair of pedal members rotates about a pivot axis and the other end is guided through a reciprocal path of travel, the angle formed by the user's ankles constantly changes between flexion and extension during the exercise cycle. Such conventional exercise devices that employ exaggerated ankle articulation and/or constant changes between flexion and extension have the disadvantage of potentially overworking a user's ankles.

SUMMARY OF THE INVENTION

The present invention provides elliptical exercise devices and methods for using an elliptical exercise device. Certain embodiments of the present invention are useful, for example, for automatically changing the orientation of an elliptical exercise motion along a continuum of orientations between horizontal and vertical. Such a change in exercise motion orientation can be made while maintaining a true elliptical exercise motion.

In one illustrative embodiment, the present invention provides an elliptical exercise device comprising a pair of pedal members, each of which is rotatably connected on one at least end to a pair of gears. The pair of gears can include a sun gear on each side of the device, an axle rotatably disposed through the sun gears, and a planet gear rigidly connected near each end of the axle for rotating about one of the sun gears. Each planet gear can be rotatably connected by a first link to one of the sun gears and by a second link to one end of a pedal member. Each of the pedal members can be rotatably connected to one of the planet gears. The pedal members and the planet gears are rotatable to provide an elliptical exercise motion. The embodiment can include a mechanism for simultaneously rotating each of the sun gears together to change the orientation of the elliptical exercise motion relative to a user.

The present invention can include embodiments of methods of using an elliptical exercise device.

Features of an elliptical exercise device and methods for making and using an elliptical exercise device embodiment of the present invention may be accomplished singularly, or in combination, in one or more of the embodiments of the present invention. As will be realized by those of skill in the art, many different embodiments of an elliptical exercise device and methods for making and using an elliptical exercise device according to the present invention are possible. Additional uses, advantages, and features of the invention are set forth in the illustrative embodiments discussed in the detailed description herein and will become more apparent to those skilled in the art upon examination of the following.

DETAILED DESCRIPTION

The present invention provides elliptical exercise devices and methods of exercising using an elliptical exercise device. Certain embodiments of the present invention are useful, for example, for automatically changing the orientation of an elliptical exercise motion along a continuum of orientations between horizontal and vertical. Such a change in exercise motion orientation can be made while maintaining a true elliptical exercise motion. FIGS. 1-13 illustrate embodiments of such an elliptical exercise device and methods.

An ellipse is defined as a plane curve, especially a conic section whose plane is not parallel to the axis, base, or generatrix of the intersected cone, or the locus of points for which the sum of the distances from each point to two fixed points is equal. (The American Heritage Dictionary of the English Language, Third Edition, 1996.)

As used herein, "exercise path," and "stride path" each refer interchangeably to the path, or curve, along which a user's feet move during an exercise cycle. "Exercise motion" refers to the movement of a user's feet along the exercise path, or curve, during an exercise cycle. In an embodiment of the present invention, the exercise motion can produce an exercise path, or curve, that is an ellipse. An "elliptical exercise path" is defined as a path of exercise motion along an elliptical curve and having a relatively longer first, or major, axis and a relatively shorter second, or minor, axis, which is perpendicular to the first axis. "Elliptical exercise motion" refers to the movement of a user's feet along an elliptical exercise path, or curve, during an exercise cycle. "Exercise motion ellipse" refers to the curve produced by elliptical exercise motion along an elliptical exercise path. Accordingly, as used herein with reference to an embodiment of the present invention, an "elliptical exercise path" refers to an elliptical path, or curve, along which a user's feet move during an exercise cycle. An elliptical exercise path or motion is referred to as horizontal when the longer, major axis is substantially parallel to the floor on which the exercise device is positioned and the minor axis is substantially perpendicular to the floor. An elliptical exercise path or motion is referred to as vertical when the longer, major axis is substantially perpendicular to the floor on which the exercise device is positioned and the minor axis is substantially parallel to the floor.

Figure 1:
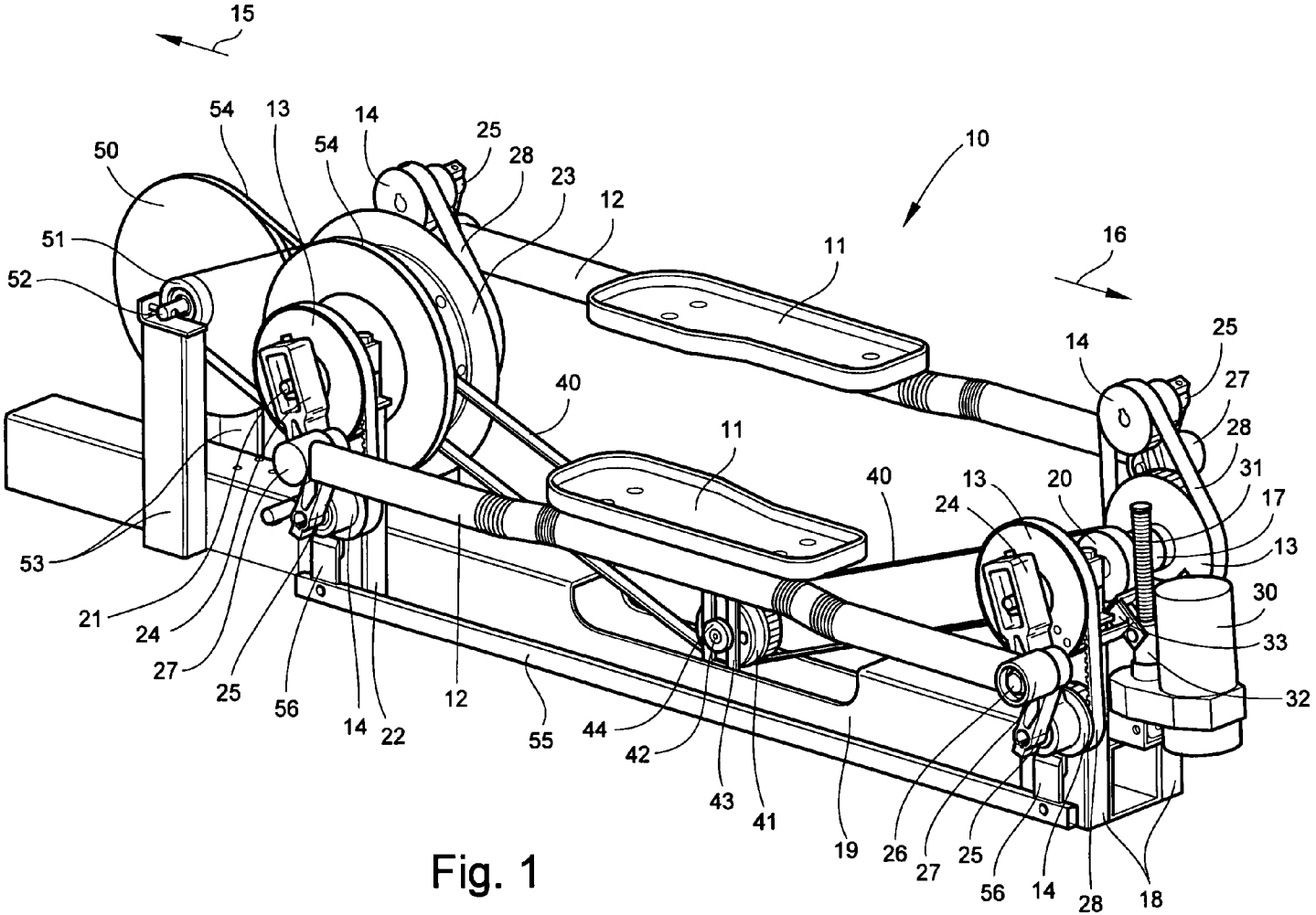
FIG. 1 is a perspective view of an elliptical exercise device having a pair of sun gears and planet gears in both the front and the rear of the device in an embodiment of the present invention.

Referring to FIG. 1, the elliptical exercise device 10 includes a pedal 11 connected to a pedal arm, or member, 12 on each side of the device 10. The device 10 includes a pair of gears on both the forward 15 end and the rearward 16 end of the device 10. Each pair of gears includes a sun gear 13 on each side of the device 10. An rear axle 17 is rotatably disposed through the pair of sun gears 13 at the rear 16 of the device 10, and a front axle 21 is rotatably disposed through the pair of sun gears 13 at the front 15 of the device 10. Each pair of gears includes a planet gear 14 rigidly connected near each end of each axle 17, 21, respectively, for rotating about one of the sun gears 13. Each pedal arm 12 is rotatably connected on each end to one of the planet gears 14 in each pair of gears.

The rearward 16 pair of gears is supported on a pair of rear vertical supports 18, which extends upwardly from a frame 19. The forward 15 pair of gears is supported on a pair of front vertical supports 22, which extends upwardly from the frame 19. The frame 19 is designed to rest on a floor surface and to provide structural support for the remaining components of the exercise device 10. Each axle 17, 21 is rotatably connected at the top of its respective vertical support 18, 22 such that the sun gears 13 are rotatable on the tops of the vertical supports 18, 22.

The center of each planet gear 14 is rotatably connected with a rigid sun gear link 24 to one of the axles 17, 21 at the center of one of the sun gears 13. The planet gear link 25 can be rotatably connected to the planet gear 14 with, for example, a pin (not shown) fixed to the center of the planet gear 14 that extends through a bore in the end of the sun gear link 24 and then though a bore in the planet gear link 25. The bores in the sun gear links 24 and the planet gear links 25 can include bearings or other means for enhancing rotation about the pin. A belt 28 operably engages the gears of each pair of sun gears 13 and planet gears 14 such that the planet gear 14 is rotatable about the sun gear 13 to which it is connected. Preferably, the sun gears 13 and planet gears 14 are configured to have teeth about the peripheral surface of the gears 13, 14. The belts 28 can include notches on the inner surface of the belts 28 that can engage the teeth of the gears 13, 14, so as to provide a smooth, positive rotation of the planet gears 14 about the sun gears 13. The center of each end of the pedal arms 12 is rotatably connected with a rigid planet gear link 25 to the center of one of the planet gears 14. Each end of the pedal arms 12 can include a pedal arm pivot ring 27 that is adapted to rotate about a pivot pin 26 extending outwardly from one end of the planet gear link 25. The pedal arm pivot ring 27 can include bearings or other means for enhancing rotation about the pivot pin 26.

Each planet gear 14 has a fixed rotatable relationship with one of the sun gears 13. One of the sun gear links 24 rigidly connects the center of one of the planet gears 14 to the center of one of the sun gears 13. The belt 28 provides a mechanism for further enhancing the smooth, positive rotation of each of the planet gears 14 about one of the sun gears 13. As a result, the center of the sun gears 13 remains fixed with respect to the rotation of the planet gears 14 about the sun gears 13.

The rotating motion of the sun gear links 24 provide the major axis of an exercise motion ellipse 60, and the rotating motion of the planet gear links 25 provide the minor axis of the exercise motion ellipse 60 (as shown in FIG. 2). Accordingly, rotation of the planet gears 14 about the sun gears 13 via the sun gear links 25 and rotation of the ends of the pedal arms 12 about the planet gears 14 via the planet gear links 25 provides an elliptical exercise motion.

In an embodiment, as shown in FIG. 1, the exercise device 10 can further include a rear gear pulley 20 disposed about the rear axle 17 between the two rear vertical supports 18. A front gear pulley 23 can be disposed about the front axle 21 between the two front vertical supports 22. The two sun gears at the rear 16 of the exercise device 10 are fixedly connected to each other with the rear axle 17. The two sun gears at the front 15 of the exercise device 10 are fixedly connected to each other with the front axle 21. The rear gear pulley 20 and the front gear pulley 23 are fixedly connected to the rear and front axles 17, 21, respectively.

In a preferred embodiment, a timing belt 40 is rotatably engaged with the rear and front gear pulleys 20, 23, respectively. An idler gear 41 can be connected to the frame 19 near the center between the rear and front gear pulleys 20, 23, respectively. As shown in FIG. 1, an idler gear support bracket 43 can be fixed to the frame 19, and the idler gear 41 can be rotatably connected to the idler gear support bracket 43. An idler gear axle 42 that extends from the center of the idler gear 41 through the idler gear support bracket 43 can be secured to the idler gear support bracket 43 with a washer 44 about the idler gear axle 42. As shown in FIG. 1, an embodiment can include two timing belts 40. One of the timing belts 40 can be rotatingly engaged between the rear gear pulleys 20 and the idler gear 41, and the other timing belt 40 can be rotatingly engaged between the idler gear 41 and the front gear pulley 23. The timing belt(s) 40 serve(s) to help synchronize the timing of the rotation of the sun gears 13 at the rear 16 of the exercise device 10 with the rotation of the sun gears 13 at the front 15 of the device 10.

In an embodiment, the pedals 11 and pedal arms 12 are in fixed relationship to one another, spaced-apart on the opposite, laterally outward sides of the front and rear vertical supports 22, 18, respectively. One pedal arm 12 and pedal 11 is phased opposite the other pedal arm 12 and pedal 11 by positioning the sun gear links 24 and planet gears 14 on the left side of the exercise device 10 at 180 degrees from the sun gear links 24 and planet gears 14 on the right side of the exercise device 10. A such, the pedals 11 and pedal arms 12 travel along identical repeating elliptical paths, but 180 degrees out of phase with one another.

The exercise device 10 can be operated for exercise when a user's feet are placed in operative contact with the foot pedals 11. The user exercises by striding forwardly (or rearwardly). As described, each pedal arm 12 is connected to the opposite side pedal arm 12 via the planet gear links 25, sun gear links 24, and axles 17, 21. The pedal arms 12 are positioned directly out of phase with each other. As a result, each striding motion of the user's feet on the foot pedals 11 pushes one pedal 11 and pedal arm 12 in one direction and the opposite pedal 11 and pedal arm 12 in the opposite direction.

Operation of the exercise device 10 can be started with the foot pedals 11 in any position. For example, with the exercise device 10 in the position illustrated in FIG. 1, the user's weight placed predominantly on the right side pedal 11 causes the right pedal arm 12 to move downwardly. The gravitational force resulting from the user's weight being predominantly on the right side pedal 11 is transmitted to the right side pedal arm 12, thus causing the right pedal arm 12 to rotate in the clockwise direction about the sun gears 13 (as viewed from the right side of the exercise device 10). A natural striding motion causes the user to initially primarily ride the right pedal 11 downward but to push rearwardly 16 more with the right side pedal 11 as the user's right foot moves farther downward, much as the user would initially bring the foot into contact with the ground and then push backward against the ground while striding to propel the user forward. This movement on the exercise device 10 moves the right pedal arm 12 rearward 16. As in a natural striding motion on the ground, as the right foot is moved rearward 16 to propel the user forward 15, the user simultaneously moves the left foot forward 15 which helps carry the left side pedal 11 and pedal arm 12.

In an embodiment of the present invention, the sun gears 13 can be rotated into different positions to change the orientation of the elliptical exercise motion relative to a user. In a preferred embodiment, the device 10 include can include a mechanism for simultaneously rotating each of the sun gears 13 together in order to change the orientation of the elliptical exercise motion. For example, as shown in the embodiment in FIG. 1, the mechanism for simultaneously rotating each of the sun gears 13 together comprises a sun gear connector 33 rigidly connected to each of the sun gears 13 in at least one of the pairs of sun gears 13. The sun gear connector 33 can be pivotally connected to a threaded collar 32. The threaded collar 32 is engaged with and movable about a threaded rod 31 by rotating the threaded rod 31.

The motor 30 can be actuated to rotate the threaded rod 31 so that the threaded collar 32 moves upward and downward along the threaded rod 31. As the threaded collar 32 moves upward and downward, the sun gear connector 33 rotates the sun gears 13 a partial turn about the sun gear axis to change the orientation of the exercise motion relative to the exerciser. The motor 30 can rotate the sun gears 13, for example, between about a ¼ turn and about a ⅜ turn, or a total movement of between about 45 and 135 degrees about the axis of the sun gears 13. Thus, the mechanism for simultaneously rotating each of the sun gears 13 is adapted to rotate each of the sun gears 13 within about a 135 degree range. In the embodiment shown in FIG. 1, the sun gears 13 are rotated at about 45 degrees above horizontal with respect to the sun gear connector 33. Rotation of the sun gears 13 causes the exercise motion ellipse 60 to re-orient about a fixed point at the center of the sun gears 13. Rotation of the sun gears 13 a partial turn rotates the sun gear links 24 a proportionate amount.

Although the motor 30 is positioned at the rear 16 of the exercise device 10 shown in FIG. 1, the motor 30 can be positioned in operable connection with the pair of sun gears 13 at the front 15 of the device 10.

An embodiment of the exercise device 10 of the present invention can change the orientation of an elliptical exercise motion dynamically from one orientation to another during a particular workout period. That is, the orientation of an elliptical exercise motion can be changed without interrupting the workout. In an embodiment, the point at which the pedal arms 12 can rotate about the planet gears 14 and the point at which the planet gears 14 can rotate about the sun gears 13 can remain fixed, and the orientation of the sun gears 13 can be changed in an automated manner, such as with actuation by the motor 30. In this manner, an embodiment of the present invention avoids the disadvantages of conventional exercise machines that require manual movement of machine components to change the exercise motion. As a result, the shape of the exercise motion can remain constant, that is, a true ellipse, while the orientation of the exercise motion is changed with respect to the user. Thus, such a change in exercise motion orientation can occur dynamically to provide a change in workout intensity without interrupting exercise.

In an embodiment of the present invention, the exercise motion ellipse 60 can be re-oriented (or "tilted") to any degree along a continuum between horizontal and vertical. In a preferred embodiment, the rotation of the sun gears 13 is such that the sun gear (major axis) link 24 and the planet gear (minor axis) link 25 are rotated so as to move, or re-orient, the exercise motion ellipse in the range of about 70 degrees in either direction above and below horizontal. However, movement of the sun gears 13 such that the sun gear and planet gear links 24, 25, respectively, are moved to re-orient the exercise motion ellipse 60 more than about 45 degrees above or below horizontal creates an exercise motion orientation that is extreme and may be too difficult for many exercisers. For example, rotating the sun gears 13 such that the sun gear links 24 and planet gear links 25 are moved to re-orient the exercise motion ellipse 60 to approximately 90 degrees above or below horizontal, the exercise motion orientation becomes nearly vertical. That is, the exercise motion approximates stepping straight up or down (similar to climbing or descending a wall).

The rear axle 17 fixedly connects, or ties, the two rear sun gears 13 together. Likewise, the front axle 21 fixedly connects, or ties, the two front sun gears 13 together. In an embodiment, the exercise device 10 can include a mechanism for connecting the pair of front sun gears 13 and the pair of rear sun gears 13 together. For example, a front-rear tie rod 55 extends between and is fixedly connected to the rear axle 17 and the front axle 21. Accordingly, when the motor 30 causes the rear sun gears 13 to rotate to change orientation of the exercise motion ellipse 60, the front-rear tie rod 55 causes the front sun gears 13 to rotate the same direction and degree as the rear sun gears 13. In this manner, all four sun gears 13 can be rotated simultaneously and identically, that is, in the same direction and in the same amount. The front-rear tie rod 55 can be a rigid material, such as steel. The front-rear tie rod 55 can be solid or can comprise a tubular shape. In an alternative embodiment, the front and rear sun gears 13 can be tied together by a front-rear tie rod 55 on each side of the device 10. That is, a left front-rear tie rod 55 can rigidly connect the left front and rear sun gears 13, and a right front-rear tie rod 55 can rigidly connect the right front and rear sun gears 13. For example, as shown in FIG. 1, the front-rear tie rod 55 can be rigidly connected to each of the front and rear main gears 13 with a tie rod-gear connector arm 56. The tie rod-gear connector arms 56 can be formed from a steel bar or other material suitable for rigidly connecting the front-rear tie rod 55 and the sun gears 13.

Figure 2A:
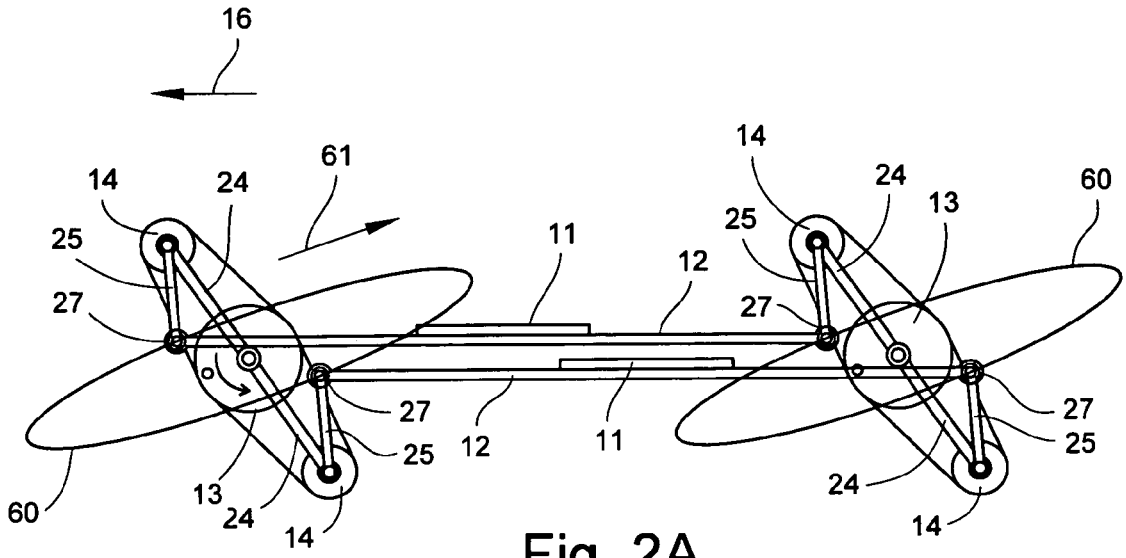
FIG. 2A is a diagrammatic view of the positioning of the planet gears relative to the sun gears that results in an elliptical exercise motion having an uphill exercise orientation in an embodiment of the present invention.
Figure 2B:
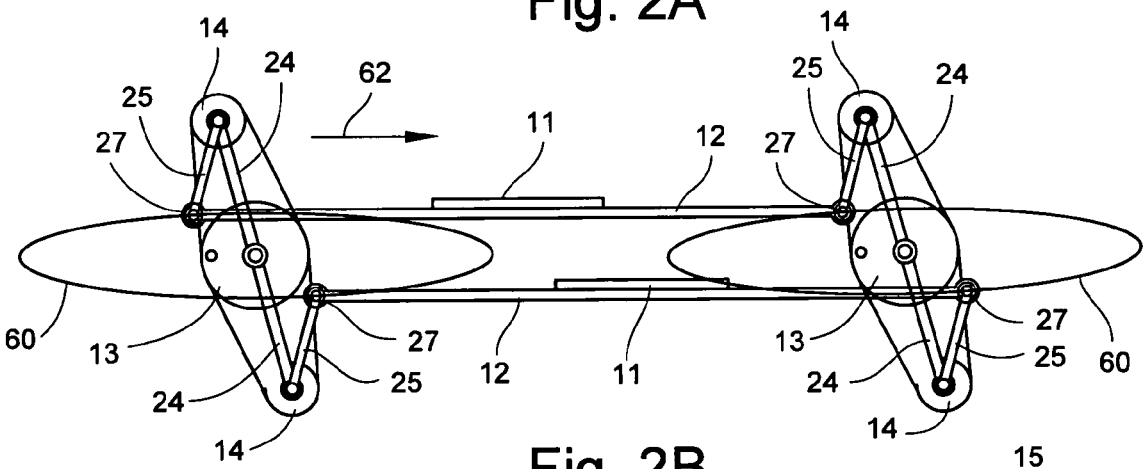
FIG. 2B is a diagrammatic view of the positioning of the planet gears relative to the sun gears that results in an elliptical exercise motion having a horizontal exercise orientation in an embodiment of the present invention.
Figure 2C:
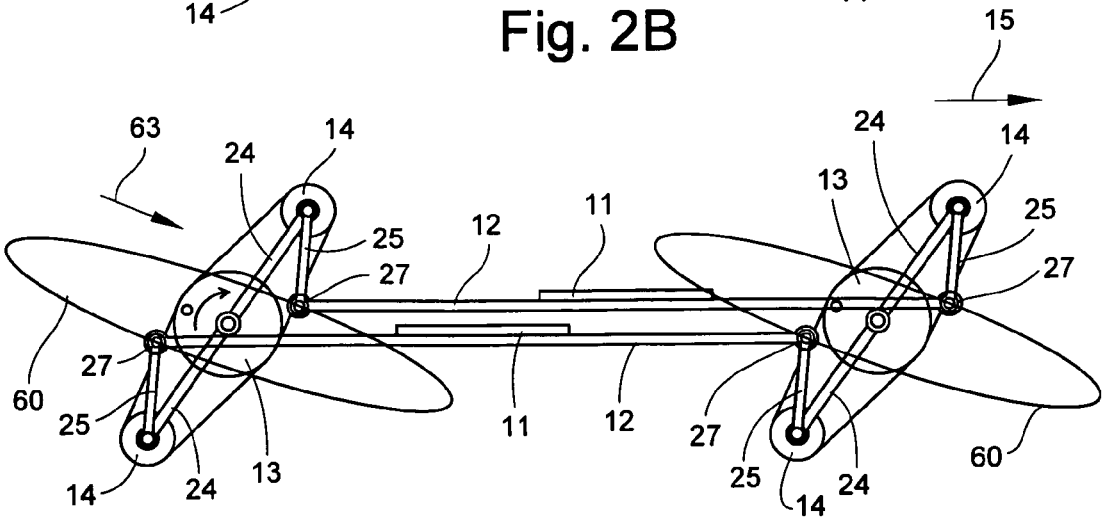
FIG. 2C is a diagrammatic view of the positioning of the planet gears relative to the sun gears that results in an elliptical exercise motion having a downhill exercise orientation in an embodiment of the present invention.

An embodiment of the present invention allows the elliptical shape of an exercise motion to be oriented to any degree along a continuum between horizontal and vertical. For example, as illustrated in FIG. 2B, the exercise motion ellipse 60 can be located with the major axis being substantially horizontal and the minor axis being substantially vertical. As illustrated in FIG. 2A, the sun gears 31 can be rotated so as to shift the sun gear links 24 in a clockwise direction, which creates an uphill orientation 61 of the exercise motion ellipse 60, resulting in a user of the device 10 experiencing a sensation of going "uphill." Conversely, as illustrated in FIG. 2C, the sun gears 13 can be rotated so as to shift the sun gear links 24 in a counter-clockwise direction, which creates an downhill orientation 63 of the exercise motion ellipse 60, resulting in a user of the device 10 experiencing a sensation of going "downhill." These motion changes can be incorporated into an automated exercise program.

An embodiment of the exercise device 10 of the present invention allows the shape of the elliptical exercise motion to remain constant, or substantially constant, while the orientation of the elliptical exercise motion changes with respect to the user. That is, the orientation of the exercise motion can be changed from the major axis of the ellipse 60 being horizontal to the major axis of the ellipse 60 being vertical without moving through other exercise path shapes, such as circular or pseudo-elliptical. A "pseudo-elliptical" exercise path or motion is an exercise path or motion that may approximate an ellipse but includes discontinuities, such as "flat" spots, along its curve, as compared to a true mathematical ellipse. As a result, an embodiment of the present invention can provide an elliptical exercise motion that can be maintained as a true ellipse in each orientation of the exercise motion and while changing the orientation of the exercise motion. An exercise motion along a true elliptical curve provides a smoother, more natural, and comfortable exercise motion than other motion paths, such as a circular or linear exercise path, or pseudo-elliptical paths.

In another aspect of the present invention, when the sun gears 13 are rotated and the exercise motion ellipse 60 is oriented at an angle relative to the horizontal plane to provide an "uphill" or "downhill" exercise motion ellipse 61, 63, respectively, a user experiences no change in angulation at the ankle as compared to a horizontal elliptical exercise motion. That is, because the positions of the sun gears 13 of the exercise device 10 remain the same relative to each other when the orientation of the exercise motion ellipse 60 is changed relative to the user, foot-ankle articulation remains the same as in a horizontal exercise motion ellipse 62. Accordingly, the user's feet remain substantially level on the pedals 11 while exercising in an "uphill" or "downhill" exercise motion ellipse 61, 63, respectively. A level orientation of a user's feet on the pedals 11 avoids the rearward 16 pressure on the user's feet from the physical movement upward of the front relative to the rear associated with conventional exercise devices to provide an actual "uphill" exercise motion. A level orientation of a user's feet on the pedals 11 avoids the forward 15 pressure on the user's feet from the physical movement upward of the rear relative to the front associated with conventional exercise devices to provide an actual "downhill" exercise motion. In this way, the user's feet remain positioned on the pedals 11 without rearward 16 or forward 15 pressures causing uncomfortable movement of the feet on the pedals 11 toward the rear 16 or front 16 of the pedals 11.

Accordingly, an embodiment of the exercise device 10 can maintain a user's feet at a substantially constant angle, for example, substantially horizontal, relative to the floor while changing the orientation of the exercise motion and after the orientation is changed. As a result, the exercise motion produces minimal flexion and extension of the user's feet and thus minimal angulation between the user's ankles and feet. Eliminating or reducing overly flexed or extended angulation at a user's ankle joints during exercise prevents the user's feet from sliding forward 15 into the front edge of the pedals 11 when the exercise motion is in a "downhill" orientation 63 and from sliding rearward 16 into the rear edge of the pedals 11 when the exercise motion is in an "uphill" orientation 61. Maintaining a user's feet at a substantially constant angle while changing the orientation of the exercise motion can reduce ankle strain and foot fatigue associated with other elliptical fitness equipment.

As shown in the embodiment in FIG. 1, the exercise device 10 can include a flywheel connected to or integrally formed with the front gear pulley 23. In an embodiment, a secondary front wheel 50 can mounted about a front wheel hub 51. A front wheel support rod 52 can extend through the front wheel hub 51, and can be supported by a front wheel vertical support 53 on each side of the device. The front wheel support rod 52 can be attached to the front wheel vertical support 53 with a cotter pin, bolt, or other suitable fastening means. The front wheel 50 is rotatably connected to the front gear pulley 23 with at least one front wheel belt 54. The front wheel 50 can be configured to increase the speed of the flywheel and front gear pulley 23. The flywheel, front gear pulley 23, and front wheel 50 are preferably sufficiently heavy so as to help move the pedal arms 12 smoothly even when the user momentarily is not supplying a moving turning force to the pedals 11.

In an embodiment, the exercise device 10 can include a load resistance mechanism (not shown). Such a load resistance mechanism can act to increase or decrease the resistance a user of the device 10 must overcome to move the pedal arms 12. Load resistance can be changed in order to vary exercise intensity. The degree of resistance to the exercise motion may be input under user control to enhance the exercise experience. The load resistance mechanism may be connected to the front wheel 50, axle(s) 17, 21, pulley(s) 20, 23, or other structures of the device 10. The load resistance mechanism can be a weight secured to the exercise device 10 for applying a resistive force against movement of the foot pedals 11. Alternatively, the load resistance mechanism can be provided with a braking mechanism, for example, magnetic resistance brakes, friction brakes, air brakes, hydraulic brakes, or other suitable braking mechanisms.

Figure 3:
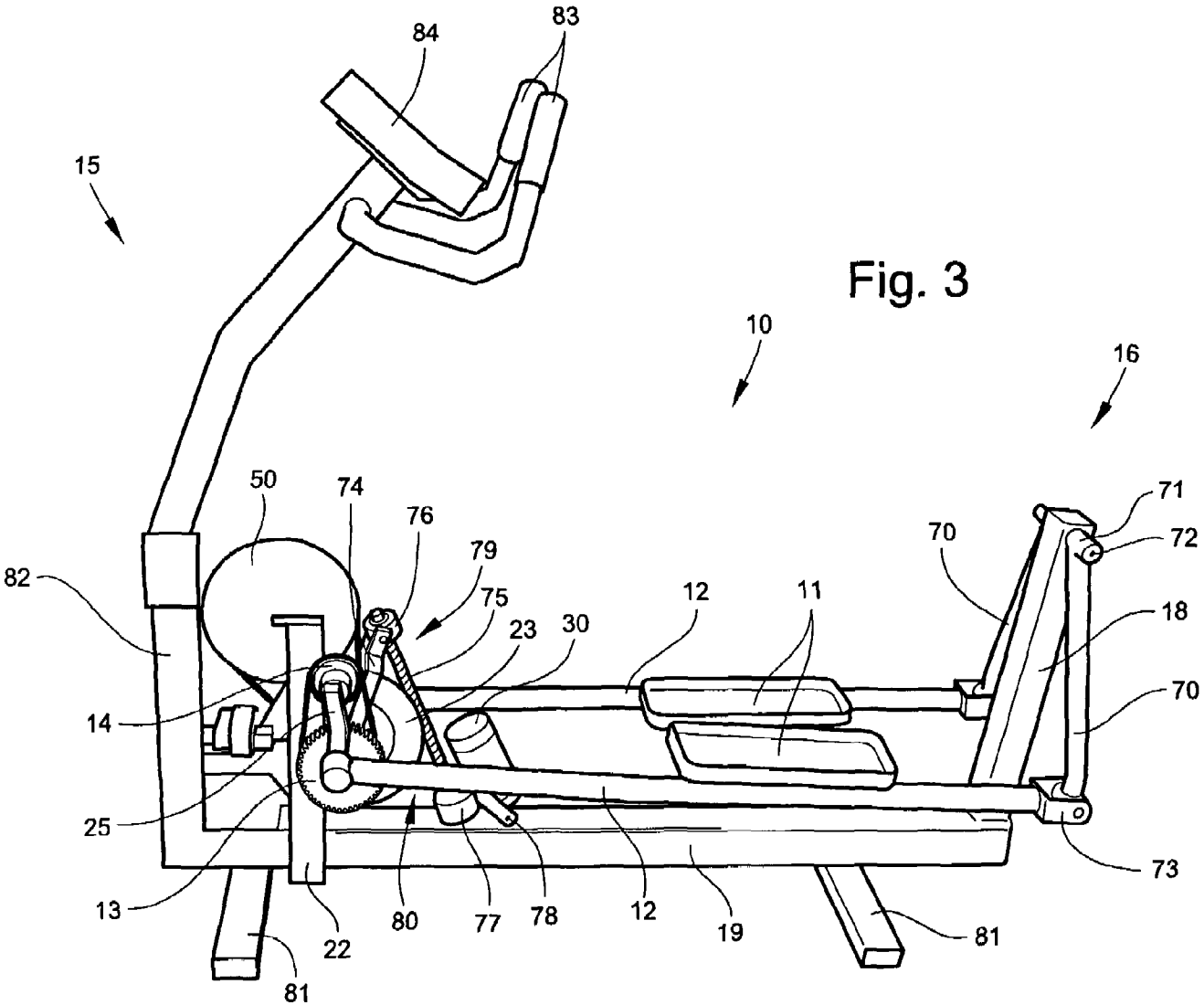
FIG. 3 is a perspective view of an elliptical exercise device having a pair of sun gears and planet gears in the front of the device in another embodiment of the present invention.

In an embodiment, the actuator, or motor 30, can be connected to a control mechanism, which can include an electronic user interface device. Such a control mechanism can be housed in a control console 84, which can be mounted on the handle support 82 (as shown in FIG. 3). The control mechanism can include a user input device operably connected to the motor 30. For example, an exerciser may change the orientation of the elliptical exercise motion by touching or otherwise interacting with a button, switch, knob, or other means on the control console 84 for signaling the motor 30. The control mechanism may include a microprocessor to control the timing for actuating the motor 30 and the degree to which the sun gears 13 are rotated. The control console 84 can include a visual display, such as a LED display or other indicia, to indicate the level of change in elliptical exercise motion orientation. The electronic control panel can also provide other exercise related information as is conventional with exercise equipment.

The changes in orientation of elliptical exercise motion provided in an embodiment of the present invention can be pre-programmed prior to an exercise period. For example, the exercise motion ellipse can be programmed in a preset exercise program stored in a microprocessor to provide a variety of combinations of "uphill" and "downhill" orientations of the exercise motion ellipse. In this way, orientation of the exercise motion ellipse can be automatically changed during an exercise period and provide variable intensity exercise throughout the period.

In an embodiment of the exercise device 10, arm exercise can be provided with handles (not shown) movably secured to the frame 19 or a structure connected to the frame 19. For example, handles can be pivotally connected on one end to an upright handle support 82 (as shown in FIG. 3) and pivotally connected on the opposite end with a coupling mechanism to one of the pedal arms 12. When the user drives the pedals 11 and pedal arms 12 with foot and leg motion during exercise, the handles can move in coordination with the pedals 11 and pedal arms 12. For example, when the left foot and pedal 11 are forward, the handle connected to the left side pedal arm 12 is rearward. At the same time in the exercise motion, the right foot and pedal 11 are positioned rearward 16 and the handle connected to the right side pedal arm 12 is forward 15. Thus, an embodiment of the present invention can provide the operator with stable foot support through various orientations of elliptical exercise motion that can simulate walking, running, jogging, and climbing with very low joint impact as well as upper body exercise.

In an embodiment of the present invention, the exercise machine 10 can simulate striding-type motions from stepping in place with little or no stride length, such as with climbing, to running with large stride lengths. "Stride" is defined as the movement of the pedals substantially forward 15 and rearward 16 along the major axis of the exercise motion ellipse 60. The stride length movements can match the natural movements of a user. "Stride length" refers to the distance between forward 15 and rearward 16 extents of travel of the user's foot during an exercise repetition. The stride length can be any length in a range suitable for humans as they walk or stride at other paces for exercise. For example, the stride length can be in the range of 18-28 inches, which accommodates typical stride lengths of persons having short legs and those having long legs. In a preferred embodiment, the stride length is between 22-24 inches, a typical stride length for many people.

The stride length can be adjusted by varying the total of the combined lengths of the sun gear link 24 and the planet gear link 25. Because a stride moves forward 15 and backward 16 about a center point, the stride length (major axis) is twice the total of the combined lengths of the sun gear link 24 and the planet gear link 25. For example, a total of the combined lengths of the sun gear link 24 and the planet gear link 25 of 12 inches provides a stride length, or major axis, of 24 inches.

"Rise" is defined as the movement of pedals substantially upwardly and downward along the minor axis of the exercise motion ellipse. The "rise" can be any height in a range suitable for humans as they move in an upward and downward stepping or striding exercise motion. For example, the rise height can be in the range of 0-12 inches. A zero inch rise, that is, no rise, is equivalent to stepping or moving on a horizontal surface without lifting one's feet from the surface, such as exercising on a ski-type exercise machine. In a preferred embodiment, the rise height is between 2 and 5 inches, a typical rise for many people during normal movement forward.

The rise height, or minor axis of the exercise motion ellipse 60, can be adjusted by varying the relative lengths of the sun gear link 24 and the planet gear link 25. The rise height, or minor axis, can be determined by first subtracting the length of the planet gear link 25 from the length of the sun gear link 24. Because the rise of an elliptical exercise motion moves upward and downward about a center point (for example, a horizontal point), the rise height is twice the total of the difference between the lengths of the sun gear link 24 and the planet gear link 25. For example, when both the sun gear link 24 and the planet gear link 25 have the same length, such as 6 inches, the rise height is zero ((6−6)=0×2=0). To determine the stride length in this embodiment, the total of the combined lengths of the sun gear link 24 (6 inches) and the planet gear link 25 (6 inches) is 12 inches, which provides a stride length of 24 inches (6+6=12×2=24).

In another illustrative embodiment in which the sun gear link 24 is 7 inches and the planet gear link 25 length is 5 inches, the rise height is 4 inches ((7−5)=2×2=4). In this embodiment, the stride length is twice the total of the combined lengths of the sun gear link 24 (7 inches) and planet gear link 25 (5 inches), or 24 inches (7+5=12×2=24). In another illustrative embodiment, the sun gear link 24 can be 7 inches and the planet gear link 25 length can be 4 inches, which creates a rise height of 6 inches ((7−4)=3×2=6), and the stride length is twice the total of the combined lengths of the sun gear link 24 (7 inches) and planet gear link 25 (4 inches), or 22 inches (7+4=11×2=22).

As shown in the embodiment in FIG. 1, the exercise device 10 of the present invention can include a pair of sun gears 13 and planet gears 14 near both the forward 15 end and the rearward 16 end of the device 10. In another embodiment, the exercise device 10 can include only one pair of sun gears 13 and planet gears 14. In such an embodiment, a single pair of sun gears 13 and planet gears 14 can be located near either the forward 15 end or the rearward 16 end of the device 10. FIG. 3 illustrates an embodiment having a single pair of sun gears 13 and planet gears 14.

In the embodiment shown in FIG. 3, the exercise motion orientation adjustment mechanism comprises a single pair of sun gears 13 and planet gears 14 preferably positioned near the forward 15 end of the exercise device 10. Alternatively, the single pair of sun gears 13 and planet gears 14 can be positioned near the rear 16 end of the device 10. The operation of the sun gears 13 and planet gears 14 in the embodiment in FIG. 3, and the mechanism for simultaneously rotating each of the sun gears 13 together to change the orientation of the elliptical exercise motion relative to a user, are similar to the configuration and operation of the sun gears 13 and planet gears 14 and mechanism for adjusting an elliptical exercise motion in the embodiment in FIG. 1.

As shown in the embodiment in FIG. 3, the exercise device 10 can include a pair of pedal arms 12, each of which is rotatably connected on one end to a pair of gears and connected on the other end to a pivot mechanism. The pair of gears can include the sun gear 13 on each side of the device 10. The axle 21 can be rotatably disposed through the sun gears 13, and one of the planet gears 14 can be rigidly connected near each end of the axle 21 for rotating about one of the sun gears 13. Each of the pedal arms 12 is rotatably connected to one of the planet gears 14. The pedal arms 12 and the planet gears 14 are rotatable so as to provide an elliptical exercise motion. The device 10 preferably includes a mechanism for simultaneously rotating each of the sun gears 13 together to change the orientation of the elliptical exercise motion relative to a user.

The center of each planet gear 14 is rotatably connected with a rigid sun gear link 24 to the axle 21 at the center of one of the sun gears 13. The planet gear link 25 can be rotatably connected to the planet gear 14 with, for example, a pin (not shown) fixed to the center of the planet gear 14 that extends through a bore in the end of the sun gear link 24 and then though a bore in the planet gear link 25. The bores in the sun gear links 24 and the planet gear links 25 can include bearings or other means for enhancing rotation about the pin. A belt 28 operably engages the gears of the pair of sun gears 13 and planet gears 14 such that the planet gear 14 is rotatable about the sun gear 13 to which it is connected. Preferably, the sun gears 13 and planet gears 14 are configured to have teeth about the peripheral surface of the gears 13, 14. The belts 28 can include notches on the inner surface of the belts 28 that can engage the teeth of the gears 13, 14, so as to provide a smooth, positive rotation of the planet gears 14 about the sun gears 13. The center of one end of each of the pedal arms 12 is rotatably connected with a rigid planet gear link 25 to the center of one of the planet gears 14. The ends of the pedal arms 12 connected to the planet gears 14 can include a pedal arm pivot ring 27 that is adapted to rotate about a pivot pin 26 extending outwardly from one end of the planet gear link 25. The pedal arm pivot ring 27 can include bearings or other means for enhancing rotation about the pivot pin 26.

Each planet gear 14 has a fixed rotatable relationship with one of the sun gears 14. One of the sun gear links 24 rigidly connects the center of one of the planet gears 14 to the center of one of the sun gears 13. The belt 28 provides a mechanism for further enhancing the smooth, positive rotation of each of the planet gears 14 about one of the sun gears 13. As a result, the center of the sun gears 13 remains fixed with respect to the rotation of the planet gears 14 about the sun gears 13.

The rotating motion of the sun gear links 24 provide the major axis of an exercise motion ellipse 60, and the rotating motion of the planet gear links 25 provide the minor axis of the exercise motion ellipse 60 (as shown in FIG. 2). Accordingly, rotation of the planet gears 14 about the sun gears 13 via the sun gear links 25 and rotation of the ends of the pedal arms 12 about the planet gears 14 via the planet gear links 25 provides an elliptical exercise motion.

As shown in the embodiment in FIG. 3, the right and left side pedal arms 12 can each be pivotally suspended at its rearward 16 end from an upright support 18 by respective laterally spaced-apart right and left swing arms 70. The swing arms 70 can be elongated, rigid links, such as metal tubes or rods. Alternatively, the swing arms 70 can be formed from flexible links, for example, made of cables, chains, straps, or another suitable flexible material. The upright support 18 extends upward from a fixed position on the frame 19. The frame legs 81 extend laterally from the frame 19 to provide stabilization support of the exercise device 10 on a floor surface.

In the embodiment shown in FIG. 3, each of the swing arms 70 is pivotally suspended about a fixed swing arm pivot rod 72 extending laterally from each side of the upright support 18. One end of each swing arm 70 includes a swing arm pivot ring 71 that is pivotable about the swing arm pivot rod 72. The swing arm pivot ring 71 may include rotary bearings and/or bushings to provide smooth pivoting of the swing arms 70 about the swing arm pivot rod 72. The opposite end of each swing arm 70 is configured to pivotally connect to the rearward 16 end of one of the pedal arms 12. In the embodiment in FIG. 3, the rearward 16 end of each pedal arm 12 includes a coupler 73. The end of each swing arm 70 opposite the end pivotally fixed to the upright support 18 is configured to pivotally fit within the coupler 73 on one side of the exercise device 10. In alternative embodiments, the pivotable connections between the swing arms 70 and the upright support 18 on one end and the pedal arms 12 on the opposite end can have other suitable configurations.

Alternative mechanisms (not shown) for guiding movement of the rear portion of the pedal arms 12 can replace the assembly comprising the swing arms 70, swing arm pivot ring 71 and rod 72, and the coupler 73. For example, the mechanism for guiding movement of the rear portion of the pedal arms 12 can include a roller mechanism connected to the pedal arms 12 that can roll forward and rearward on a pair of arched ramps.

The mechanism for simultaneously rotating each of the sun gears can include an elevation arm 74 rigidly connected to each of the sun gears 13, a threaded nut 76 pivotally connected to the elevation arm 74 and threaded about an elevation rod 75. The motor 30 is operably connected to the elevation rod 75 such that the motor 30 rotate the elevation rod 75 within the nut 76 to pivot the elevation rod 75 forward and rearward. In this way, the sun gears 13 can be simultaneously rotated.

The motor 30 and elevation rod 75 can be supported by a motor-elevation rod base 77, which can be pivotally connected at base pivot 78 to the frame. The motor 30 can be actuated to move the sun gears 13 up or down, for example, between about a ⅛ turn and about a ¼ turn, or a total movement of between about 45 and 90 degrees, about a horizontal axis. As the elevation arm 74 and attached sun gear 13 are moved downward from the top 79 of the elevation rod 75, the orientation of the resulting exercise motion ellipse 60 becomes gradually more vertical. As the exercise motion ellipse 60 becomes more vertical, the exercise motion becomes a correspondingly more "uphill" motion. For example, when the elevation arm 74 and nut 76 are positioned approximately half-way between the top 79 and the bottom 80 of the elevation rod 75, the exercise motion ellipse 60 is oriented at about a 45 degree uphill angle.

An embodiment of the exercise device 10 of the present invention, as shown in FIG. 3, for example, can change the orientation of an elliptical exercise motion dynamically, or automatically, from one orientation to another during a particular workout period without requiring manual movement of machine components to change the exercise motion. That is, the orientation of an elliptical exercise motion can be changed without interrupting the workout. As a result, the shape of the exercise motion can remain constant, that is, a true ellipse, while the orientation of the exercise motion is changed with respect to the user.

In the embodiment shown in FIG. 3, the exercise motion ellipse 60 can be re-oriented to any degree along a continuum between horizontal and vertical. In a preferred embodiment, the rotation of the sun gears 13 is such that the sun gear (major axis) link 24 and the planet gear (minor axis) link 25 are rotated so as to move, or re-orient, the exercise motion ellipse in the range of about 70 degrees in either direction above and below horizontal.

The exercise device 10 shown in FIG. 3 can include a pair of handles 83 connected to the handle support 82. The handles 83 can serve to assist the user in keeping balance during operation of the exercise device 10. In an alternative embodiment, a means for support of the user's upper body can be configured as a handle bar or multiple handles (not shown) for grasping in different positions.

In the embodiment shown in FIG. 3, the motor 30, can be connected to a control mechanism, which can include an electronic user interface device. Such a control mechanism can be housed in the control console 84, which can be mounted on the handle support 82. The control mechanism can include a user input device operably connected to the motor 30. For example, an exerciser may change the orientation of the elliptical exercise motion by touching or pushing on the control console 84 a button, switch, knob, or other means for signaling the motor 30. The control mechanism may include a microprocessor to control the timing for actuating the motor 30 and the degree to which the sun gears 13 are rotated, and thereby create various workout programs.

Figure 4B:
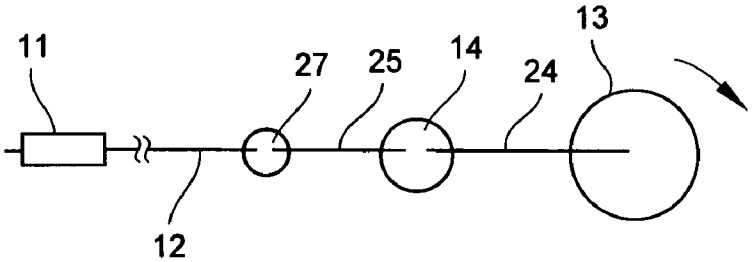
FIGS. 4A/B-7A/B are diagrammatic views illustrating the relative positions of the sun gears, sun gear links, planet gears, planet gear links, pedal arm pivot rings, and pedals on the right side (FIGS. 4A-7A) and on the left side (FIGS. 4B-7B) of an elliptical exercise device at various points along a horizontal exercise motion ellipse in an embodiment of the present invention.
Figure 4A:
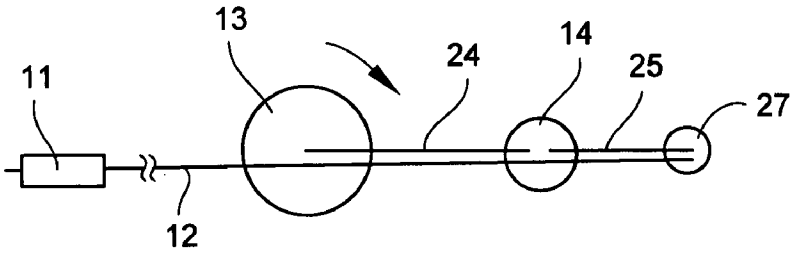

FIGS. 4A/B-11A/B illustrate the movements of rotatable components, including the sun gear links 24, planet gears 14, planet gear links 25, pedal arm pivot rings 27, and pedals 11 of the exercise device 10 through one elliptical curve 60 of exercise motion. During one elliptical curve 60 of exercise motion, the pedals 12, for example, move from a starting point on the curve through the entire ellipse 60 back to that starting point. These illustrations depict the rotational movement during an exercise cycle of the planet gear 14 about its respective sun gear 13 and the rotational movement of the pedal arm pivot ring 27 about the planet gear 14 to which it is connected. FIGS. 4A/B-11A/B illustrate movement in the clockwise direction 94, which represents a user's forward striding motion during exercise. However, the pedals 11 of an elliptical exercise device 10 of the present invention can be moved by a user in a counterclockwise direction to create a rearwardly 16 directed exercise motion. In such a rearwardly 16 directed exercise motion, the movements of the rotatable components, including the planet gears 14 and the pedal arm pivot rings 27, are the reverse of the movements illustrated in FIGS. 4A/B-11A/B.

FIGS. 4A-11A illustrate the relative positions of the sun gears 13, sun gear links 24, planet gears 14, planet gear links 25, pedal arm pivot rings 27, and pedals 11 on the right side of the elliptical exercise device 10 at various points along the exercise motion ellipse 60. Likewise, FIGS. 4B-11B illustrate the relative positions of the sun gears 13, sun gear links 24, planet gears 14, planet gear links 25, pedal arm pivot rings 27, and pedals 11 on the left side of the elliptical exercise device 10 at various points along the exercise motion ellipse 60. In a preferred embodiment, the planet gears 14 and pedal arm pivot rings 27 on one side of the exercise device 10 are configured so as to be positioned, or phased, 180 degrees from the planet gears 14 and pedal arm pivot rings 27 on the opposite side of the exercise device 10. Accordingly, the positions of the planet gears 14 and pedal arm pivot rings 27 on the right side of the exercise device 10 illustrated in FIG. 4A are phased 180 degrees from the planet gears 14 and pedal arm pivot rings 27 on the left side of the exercise device 10 illustrated in FIG. 4B. That is, when the components on the right side of the exercise device 10 are in the positions illustrated in FIG. 4A, the respective components on the left side of the exercise device 10 are in the positions illustrated in FIG. 4B. This same phased positioning of the planet gears 14 and pedal arm pivot rings 27 is illustrated in each of the companion drawings FIGS. 4A-B through FIGS. 11A-B.

In FIGS. 4A-B through FIGS. 7A-B, the exercise motion ellipse 60 produced by the illustrated clockwise 94 movements is horizontal. A horizontal exercise motion ellipse 62 (as shown in FIG. 2B) is produced in the embodiment shown in FIG. 1 when the threaded collar 32 is positioned approximately half way up the threaded rod 31 such that the sun gear links 24 and the planet gear links 25 are both in horizontal position. A horizontal exercise motion ellipse 62 is produced in the embodiment shown in FIG. 3 when the elevation arm 74 and nut 76 are moved to the uppermost end 79 of the elevation rod 75 and the elevation rod 75 is pivoted toward the front 15 of the exercise device 10.

Figure 12:
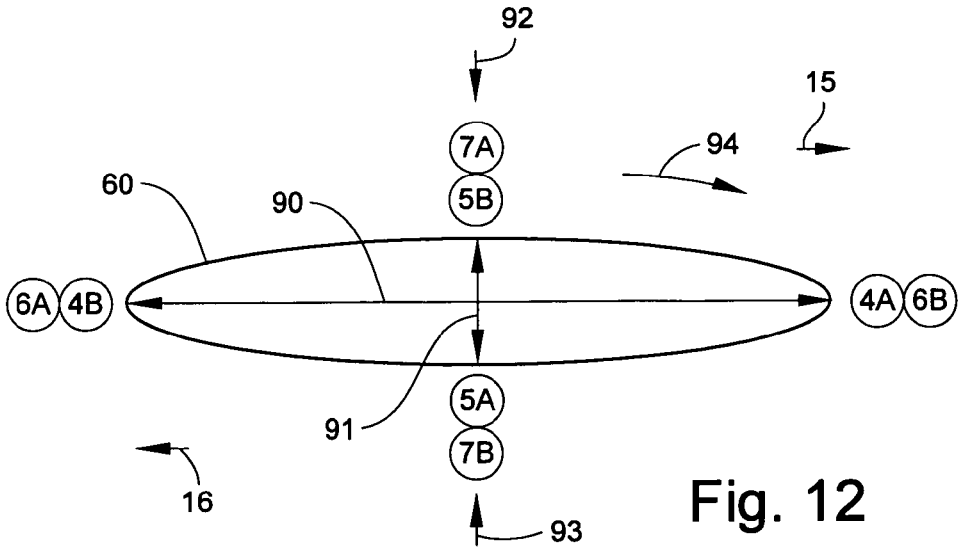
FIG. 12 is a diagrammatic view illustrating the relative positions of the right and left side pedals illustrated in FIGS. 4A/B-FIGS. 7A/B along the major and minor axes of a horizontal elliptical exercise curve during an exercise cycle in an embodiment of the present invention.

As illustrated in FIG. 4A, the right side planet gear 14 and pedal arm pivot ring 27 are each extended horizontally forward 15, placing the right side pedal 11 in its forwardmost position in the horizontal plane (along the major axis 90 of the ellipse 60). When the right side planet gear 14 and pedal arm pivot ring 27 are in this position, the left side planet gear 14 and pedal arm pivot ring 27 (FIG. 4B) are each extended horizontally rearward 16, placing the left side pedal 11 in its rearwardmost position in the horizontal plane (along the major axis 90 of the ellipse 60). In this position, the right side and left side pedals 11 are at their greatest distance apart during the exercise cycle. As shown in FIG. 12, in the positions illustrated in FIGS. 4A and 4B, the right side pedal 11 is located at one (or forward 15) end of the major axis 90 of the exercise motion ellipse 60, while the left side pedal 11 is located at the opposite (or rearward 16) end of the major axis 90 of the ellipse 60.

Figure 5B:
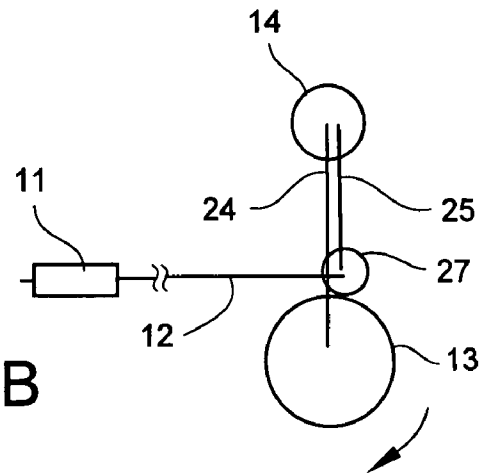
Figure 5A:
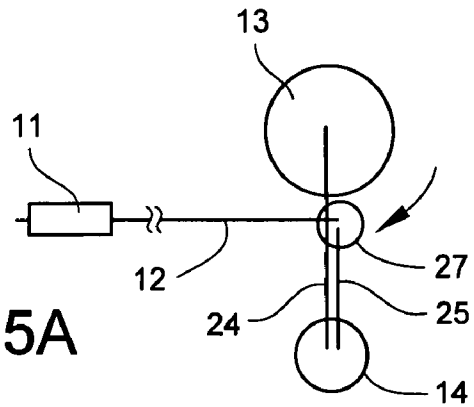

FIGS. 5A and 5B represent the positions of the right and left side planet gears 14 and pedal arm pivot rings 27 after being rotated one quarter turn in the clockwise direction 94 (see FIG. 12) about their respective sun gears 13 from the positions illustrated in FIGS. 4A and 4B. As illustrated in FIG. 5A, the right side planet gear 14 is extended vertically downward and the right side pedal arm pivot ring 27 is extended vertically upward, placing the right side pedal 11 in a vertical and relatively downward position from the horizontal plane (along the minor axis 91 of the ellipse 60). When the right side planet gear 14 and pedal arm pivot ring 27 are in this position, the left side planet gear 14 (FIG. 5B) is extended vertically upward and the left side pedal arm pivot ring 27 is extended vertically downward, placing the left side pedal 11 in a vertical and relatively upward position from the horizontal plane (along the minor axis 91 of the ellipse 60). In this position, the right side and left side pedals 11 are at the point of being closest together during the exercise cycle. As shown in FIG. 12, in the positions illustrated in FIGS. 5A and 5B, the right side pedal 11 is located at bottom end 93 of the minor axis 91 of the exercise motion ellipse 60, while the left side pedal 11 is located at the top end 92 of the minor axis 91 of the ellipse 60.

Figure 6B:
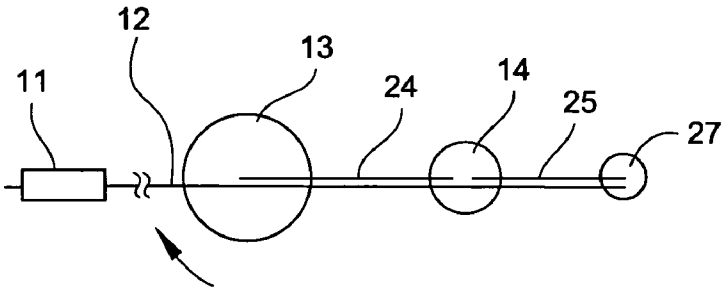
Figure 6A:
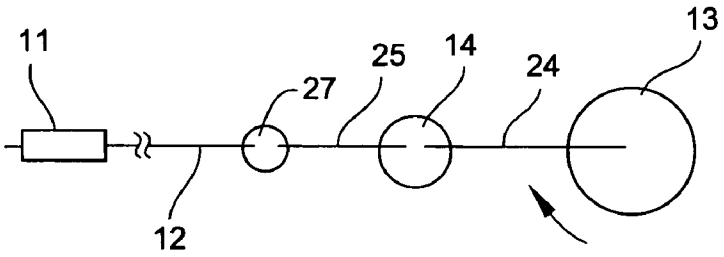

FIGS. 6A and 6B represent the positions of the right and left side planet gears 14 and pedal arm pivot rings 27 after being rotated one quarter turn in the clockwise direction 94 about their respective sun gears 13 from the positions illustrated in FIGS. 5A and 5B. As illustrated in FIG. 6A, the right side planet gear 14 and pedal arm pivot ring 27 are each extended horizontally rearward 16, placing the right side pedal 11 in its rearwardmost position in the horizontal plane (along the major axis 90 of the ellipse 60). When the right side planet gear 14 and pedal arm pivot ring 27 are in this position, the left side planet gear 14 and pedal arm pivot ring 27 (FIG. 6B) are each extended horizontally forward 15, placing the left side pedal 11 in its forwardmost position in the horizontal plane (along the major axis 90 of the ellipse 60). In this position, the right side and left side pedals 11 are again at their greatest distance apart during the exercise cycle. As shown in FIG. 12, in the positions illustrated in FIGS. 6A and 6B, the right side pedal 11 is located at the rearward 16 end of the major axis 90 of the exercise motion ellipse 60, while the left side pedal 11 is located at the forward 15 end of the major axis 90 of the ellipse 60.

Figure 7B:
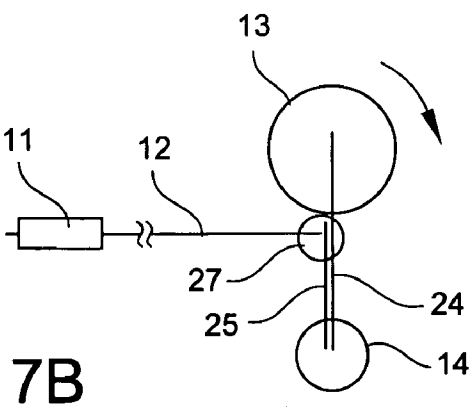
Figure 7A:
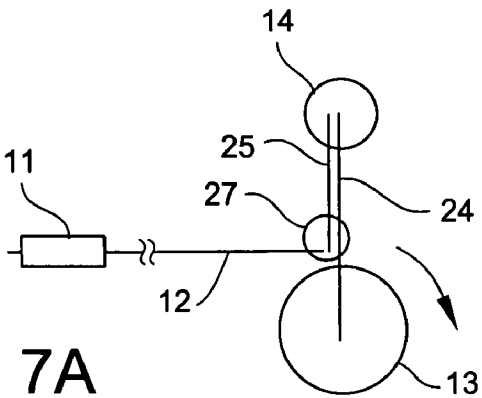

FIGS. 7A and 7B represent the positions of the right and left side planet gears 14 and pedal arm pivot rings 27 after being rotated one quarter turn in the clockwise direction 94 about their respective sun gears 13 from the positions illustrated in FIGS. 6A and 6B. As illustrated in FIG. 7A, the right side planet gear 14 is extended vertically upward and the right side pedal arm pivot ring 27 is extended vertically downward, placing the right side pedal 11 in a vertical and relatively upward position from the horizontal plane (along the minor axis 91 of the ellipse 60). When the right side planet gear 14 and pedal arm pivot ring 27 are in this position, the left side planet gear 14 (FIG. 7B) is extended vertically downward and the left side pedal arm pivot ring 27 is extended vertically upward, placing the left side pedal 11 in a vertical and relatively downward position from the horizontal plane (along the minor axis 91 of the ellipse 60). In this position, the right side and left side pedals 11 are again at the point of being closest together during the exercise cycle. As shown in FIG. 12, in the positions illustrated in FIGS. 7A and 7B, the right side pedal 11 is located at top end 92 of the minor axis 91 of the exercise motion ellipse 60, while the left side pedal 11 is located at the bottom end 93 of the minor axis 91 of the ellipse 60.

The right and left side planet gears 14 and pedal arm pivot rings 27 can be rotated another one quarter turn in the clockwise direction 94 about their respective sun gears 13 from the positions illustrated in FIGS. 7A and 7B, back to their original positions illustrated in FIGS. 4A and 4B. Thus, FIGS. 4A-B through 7A-B represent the progression of movements of the sun gear links 24, planet gears 14, planet gear links 25, pedal arm pivot rings 27, and pedals 11 of the exercise device 10 through one horizontal exercise motion ellipse 60.

In FIGS. 8A-B through FIGS. 11A-B, the exercise motion ellipse 60 produced by the illustrated clockwise 94 movements is vertical. A vertical exercise motion ellipse is produced in the embodiment shown in FIG. 1 when the sun gears 13 are moved such that the sun gear links 24 and the planet gear links 25 are both in a vertical position. A vertical exercise motion ellipse 60 is produced in the embodiment shown in FIG. 3 when the elevation arm 74 and nut 76 are moved to the lowermost end 80 of the elevation rod 75 and the elevation rod 75 is substantially perpendicular to the floor. While an exercise motion along a completely vertical ellipse may not be preferred by users for exercise, movement of components of the exercise device 10 along a vertical exercise motion ellipse 60 illustrates the range of elliptical exercise motions available in an embodiment of the device 10.

Figure 8B:
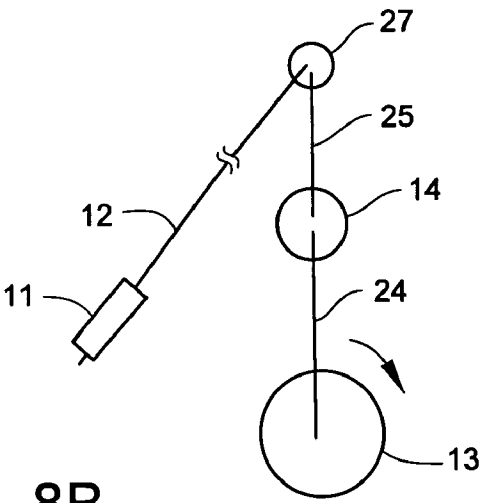
FIGS. 8A/B-11A/B are diagrammatic views illustrating the relative positions of the sun gears, sun gear links, planet gears, planet gear links, pedal arm pivot rings, and pedals on the right side (FIGS. 8A-11A) and on the left side (FIGS. 8B-11B) of an elliptical exercise device at various points along a vertical exercise motion ellipse in an embodiment of the present invention.
Figure 8A:
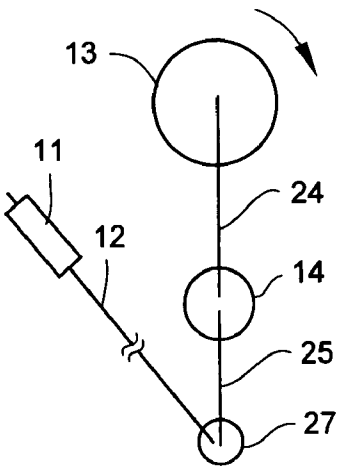
Figure 13:
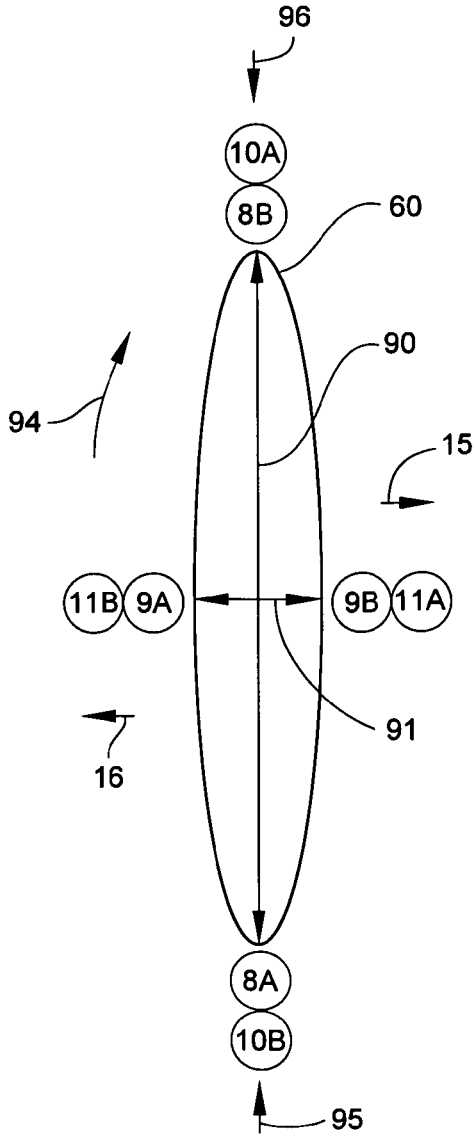
FIG. 13 is a diagrammatic view illustrating the relative positions of the right and left side pedals illustrated in FIGS. 8A/B-FIGS. 11A/B along the major and minor axes of a vertical elliptical exercise curve during an exercise cycle in an embodiment of the present invention.

As illustrated in FIG. 8A, the right side planet gear 14 and pedal arm pivot ring 27 are each extended vertically downward, placing the right side pedal 11 in its downwardmost position in the vertical plane (along the major axis 90 of the ellipse 60). When the right side planet gear 14 and pedal arm pivot ring 27 are in this position, the left side planet gear 14 and pedal arm pivot ring 27 (FIG. 8B) are each extended vertically upward, placing the left side pedal 11 in its upwardmost position in the vertical plane (along the major axis 90 of the ellipse 60). In this position, the right side and left side pedals 11 are at their greatest distance apart during the exercise cycle. As shown in FIG. 13, in the positions illustrated in FIGS. 8A and 8B, the right side pedal 11 is located at the bottom end 95 of the major axis 90 of the exercise motion ellipse 60, while the left side pedal 11 is located at the top end 96 of the major axis 90 of the ellipse 60.

Figure 9B:
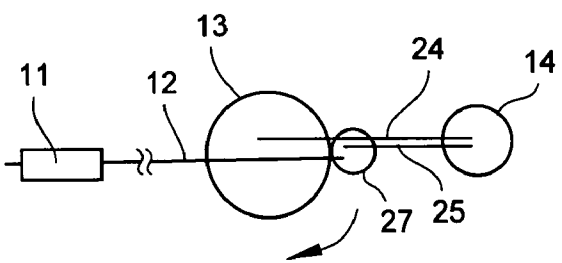
Figure 9A:
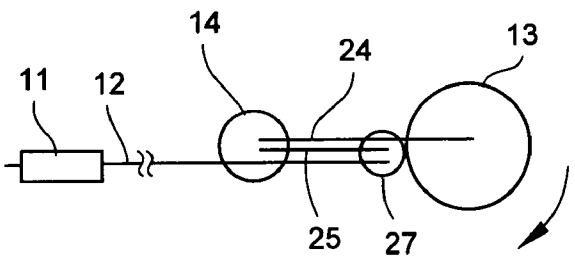

FIGS. 9A and 9B represent the positions of the right and left side planet gears 14 and pedal arm pivot rings 27 after being rotated one quarter turn in the clockwise direction 94 about their respective sun gears 13 from the positions illustrated in FIGS. 8A and 8B. As illustrated in FIG. 9A, the right side planet gear 14 is extended horizontally rearward 16 and the right side pedal arm pivot ring 27 is extended horizontally forward 15, placing the right side pedal 11 in a horizontal and relatively rearward 16 position from the vertical plane (along the minor axis 91 of the ellipse 60). When the right side planet gear 14 and pedal arm pivot ring 27 are in this position, the left side planet gear 27 (FIG. 9B) is extended horizontally forward 15 and the left side pedal arm pivot ring 27 is extended horizontally rearward 16, placing the left side pedal 11 in a horizontal and relatively forward 15 position from the vertical plane (along the minor axis 91 of the ellipse 60). In this position, the right side and left side pedals 11 are at the point of being closest together during the exercise cycle. As shown in FIG. 13, in the positions illustrated in FIGS. 9A and 9B, the right side pedal 11 is located at the rearward 16 end of the minor axis 91 of the exercise motion ellipse 60, while the left side pedal 11 is located at the forward 15 end of the minor axis 91 of the ellipse 60.

Figure 10B:
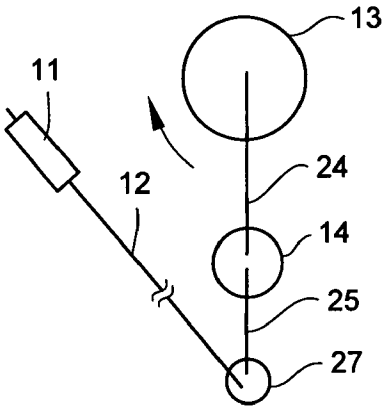
Figure 10A:
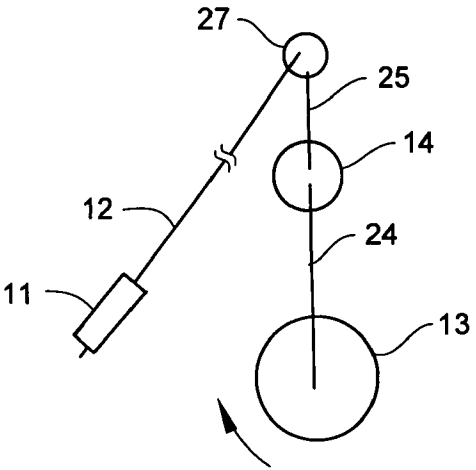

FIGS. 10 and 10B represent the positions of the right and left side planet gears 14 and pedal arm pivot rings 27 after being rotated one quarter turn in the clockwise direction 94 about their respective sun gears 13 from the positions illustrated in FIGS. 9A and 9B. As illustrated in FIG. 10A, the right side planet gear 14 and pedal arm pivot ring 27 are each extended vertically upward, placing the right side pedal 11 in its upwardmost position in the vertical plane (along the major axis 90 of the ellipse 60). When the right side planet gear 14 and pedal arm pivot ring 27 are in this position, the left side planet gear 14 and pedal arm pivot ring 27 (FIG. 10B) are each extended vertically downward, placing the left side pedal 11 in its downwardmost position in the vertical plane (along the major axis 90 of the ellipse 60). In this position, the right side and left side pedals 11 are again at their greatest distance apart during the exercise cycle. As shown in FIG. 13, in the positions illustrated in FIGS. 10A and 10B, the right side pedal 11 is located at the top end 96 of the major axis 90 of the exercise motion ellipse 60, while the left side pedal 11 is located at the bottom end 93 of the major axis 90 of the ellipse 60.

Figure 11B:
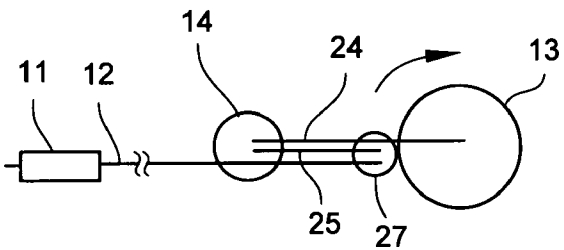
Figure 11A:
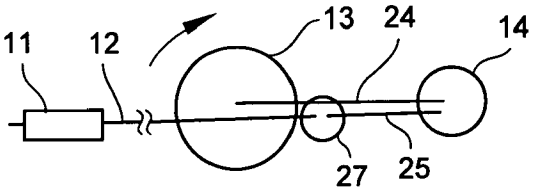

FIGS. 11A and 11B represent the positions of the right and left side planet gears 14 and pedal arm pivot rings 27 after being rotated one quarter turn in the clockwise direction 94 about their respective sun gears 13 from the positions illustrated in FIGS. 10A and 10B. As illustrated in FIG. 11A, the right side planet gear 14 is extended horizontally forward 15 and the right side pedal arm pivot ring 27 is extended horizontally rearward 16, placing the right side pedal 11 in a horizontal and relatively forward 15 position from the vertical plane (along the minor axis 91 of the ellipse 60). When the right side planet gear 14 and pedal arm pivot ring 27 are in this position, the left side planet gear 14 (FIG. 11B) is extended horizontally rearward 16 and the left side pedal arm pivot ring 27 is extended horizontally forward 15, placing the left side pedal 11 in a horizontal and relatively rearward position from the vertical plane (along the minor axis 91 of the ellipse 60). In this position, the right side and left side pedals 11 are thus again at the point of being closest together during the exercise cycle. As shown in FIG. 13, in the positions illustrated in FIGS. 11A and 11B, the right side pedal 11 is located at the forward 15 end of the minor axis 91 of the exercise motion ellipse 60, while the left side pedal 11 is located at the rearward 16 end of the minor axis 91 of the ellipse 60.

The right and left side planet gears 14 and pedal arm pivot rings 27 can be rotated another one quarter turn in the clockwise direction 94 about their respective sun gears 13 from the positions illustrated in FIGS. 11A and 11B, back to their original positions illustrated in FIGS. 8A and 8B. Thus, FIGS. 8A-B through 11A-B represent the progression of movements of the sun gear links 24, planet gears 14, planet gear links 25, pedal arm pivot rings 27, and pedals 11 of the exercise device 10 through one vertical exercise motion ellipse 60.

The present invention includes embodiments of a device adapted to change the orientation of an elliptical motion 60. For example, such a device can comprise at least one pair of sun gears 13, each of which is rigidly connected to the other sun gear 13 in the pair. The axle 17 or 21 can be rotatably disposed through each pair of sun gears 13. The planet gear 14 can be rigidly connected near each end of each axle 17 or 21 for rotating about one of the sun gears 13. The device can further include a pair of longitudinal members, each of which is rotatably connected on at least one end to one of the planet gears 14. The longitudinal members and the planet gears 14 are rotatable to provide an elliptical motion 60. The device can include a mechanism for rotating each of the sun gears 13 together to change the orientation of the elliptical motion 60 relative to a force exerted against the longitudinal members.

In one embodiment of a device adapted to change the orientation of an elliptical motion 60, the mechanism for rotating each of the sun gears 13 can include the arm 74 rigidly connected to at least the sun gears 13 in one pair of sun gears 13 (as shown in FIG. 3). The threaded nut 76 can be pivotally connected to the arm 64 and threaded about the elevation rod 75. The actuator 30 can be operably connected to the elevation rod 75 and can pivot the elevation rod 75 by rotating the elevation rod 75 within the nut 76, thereby rotating the sun gears 13. In an another embodiment, the mechanism for rotating each of the sun gears 13 can include the sun gear connector 33 rigidly connected to at least the sun gears 13 in one pair of sun gears 13 and pivotally connected to the threaded collar 32 (as shown in FIG. 1). The threaded collar 32 can be engaged with and movable longitudinally about the threaded rod 31 by rotating the threaded rod 31, thereby rotating the sun gears 13.

An embodiment of a device adapted to change the orientation of an elliptical motion 60 can include a first link, such as the sun gear link 24, rotatably connecting each planet gear 14 to one of the sun gears 13 and a second link, such as the planet gear link 25, rotatably connecting one end of each longitudinal member to one of the planet gears 14. The first link and the second link each have a length. The length of the major axis 90 of the elliptical motion 60 comprises twice the combined lengths of the first and second links. The height of the minor axis 91 of the elliptical motion 60 comprises twice the difference between the lengths of the first and second links.

In an embodiment of a device adapted to change the orientation of an elliptical motion 60, the planet gear 14 near one end of the axle 17 or 21 is positioned on the axle at 180 degrees from the planet gear 14 near the opposite end of the axle 17 or 21. In an embodiment, the mechanism for rotating each of the sun gears 13 is adapted to rotate each of the sun gears 13 within a 135 degree range. In an embodiment, the orientation of the elliptical motion 60 be an elliptical motion that is oriented horizontal 62, uphill 61, or downhill 63 relative to a force exerted against the longitudinal members.

Embodiments of the present invention include methods of exercising. In a particular embodiment, a method of exercising can include using an elliptical exercise device 10 as described herein. For example, in an embodiment of a method of exercising, a user can access the exercise device 10 comprising a pair of pedal arms, or members 12. At least one end of each of the pedal members 12 can be rotatably connected to a planet gear 14 on each side of the device 10. Each planet gear 14 may be rigidly connected near each end of an axle 17, 21, and the axle 17, 21 can be rotatably disposed through a sun gear 13 on each side of the device 10. Each of the planet gears 14 can be rotated about one of the sun gears 13. The pedal members 12 and the planet gears 14 can be rotated to provide an elliptical exercise motion. During exercise, the user of the device 10 can simultaneously rotate each of the sun gears 13 together to change the orientation of the elliptical exercise motion relative to the user.

In an embodiment of a method of exercise, each of the sun gears 13 can be simultaneously rotated together within a 135 degree range. In such an embodiment, each of the sun gears 13 can be simultaneously rotated together to change the orientation of the elliptical exercise motion to an orientation that is horizontal 62, uphill 61, or downhill 63 relative to the user. In another embodiment, the pedal members 12 can be maintained in a substantially horizontal plane when the sun gears 13 are simultaneously rotated together. In another embodiment, the exercise device 10 can include a handle pivotally connected to the forward 15 end of each of the pedal members 12. The method can thereby include moving the pedal members 12 and the handles together during exercise.

In yet another embodiment, the exercise device 10 can include a control mechanism that can be actuated to control rotation of the sun gears 13 and the orientation of the elliptical exercise motion. The user may actuate the control mechanism during exercise to rotate the sun gears 13 and re-orient the elliptical exercise motion to a particular orientation desired during the exercise. Alternatively, the user may program a particular workout regimen prior to beginning exercise, or utilize a pre-programmed workout regimen, to automatically control rotation of the sun gears 13 and re-orient the elliptical exercise motion at pre-determined times and to pre-determined degrees during a workout period.

Embodiments of the present invention can be applied to devices and methods other than those involving fitness equipment. For example, other devices can include the configuration of at least one end of a pair of pedal members 12 rotatably connected to a planet gear 14 that is, in turn, rotatable about a sun gear 13, in which the pedal members 12 and the planet gears 14 are rotatable to provide an elliptical exercise motion, and which includes a mechanism for simultaneously rotating each of the sun gears 13 together to change the orientation of the elliptical exercise motion relative to a user. Such a device may be utilized, for example, to change the orientation of motion of users gaining experience in an environment having less gravity than the earth. As another example, such a device may be utilized to change the orientation of motion for users in a health care or rehabilitation setting, without placing undesired stress on ankle joints and feet.

Although the present invention has been described with reference to particular embodiments, it should be recognized that these embodiments are merely illustrative of the principles of the present invention. Those of ordinary skill in the art will appreciate that an elliptical exercise device and methods for using an elliptical exercise device according to the present invention may be constructed and implemented in other ways and embodiments. Accordingly, the description herein should not be read as limiting the present invention, as other embodiments also fall within the scope of the present invention.

What is claimed is:

1. An exercise device, comprising:

a pair of pedal arms, each of which is rotatably connected on one end to a pair of gears and connected on the other end to a pivot mechanism comprising an upright support and a pair of swing arms, each swing arm pivotally suspended on one end about a side of the upright support and on the opposite end to one of the pedal members, the pair of gears comprising a sun gear on each side of the device, an axle rotatably disposed through the sun gears, and a planet gear rigidly connected near each end of the axle for rotating about one of the sun gears, each of the pedal arms rotatably connected to at least one of the planet gears, the pedal arms and the planet gears rotatable to provide an elliptical exercise motion; and a mechanism adapted to simultaneously rotate each of the sun gears together to change the orientation of the elliptical exercise motion relative to a user wherein the mechanism for simultaneously rotating each of the sun gears comprises an arm rigidly connected to each of the sun gears, a threaded nut pivotally connected to the arm and threaded about an elevation rod, and an actuator operably connected to the elevation rod for pivoting the elevation rod forward and rearward by rotating the elevation rod within the nut.

2. The exercise device of claim 1, further comprising a first link rotatably connecting each planet gear to at least one of the sun gears and a second link rotatably connecting one end of each pedal arm to at least one of the planet gears.

3. The exercise device of claim 2, the first link and the second link each comprising a length, wherein a stride length of the elliptical exercise motion comprises twice the combined lengths of the first and second links, and a rise height of the elliptical exercise motion comprises twice the difference between the lengths of the first and second links.

4. The exercise device of claim 1, wherein the planet gear near one end of the axle is positioned on the axle at 180 degrees from the planet gear near the opposite end of the axle.

5. The exercise device of claim 1, wherein the mechanism for simultaneously rotating each of the sun gears is adapted to rotate each of the sun gears within a 135 degree range.

6. The exercise device of claim 1, wherein the orientation of the elliptical exercise motion comprises an elliptical exercise motion orientation that is horizontal, uphill, or downhill relative to the user.

7. The exercise device of claim 1, wherein the mechanism for simultaneously rotating each of the sun gears is adapted to maintain the pedal arms in a substantially horizontal plane when the sun gears are rotated.

8. The exercise device of claim 1, further comprising a handle pivotally connected to a forward end of each of the pedal arms.

* * * * *